US005761750A

United States Patent [19]

Mazzola et al.

[11] Patent Number: 5,761,750

[45] Date of Patent: Jun. 9, 1998

[54] HOT TUB WITH COVERING APPARATUS

[76] Inventors: Charles Thomas Mazzola, 62280 Powell Butte Hwy.; Roger Alan Skaggs, 1331 NW. Quincy, both of Bend, Oreg. 97701

[21] Appl. No.: 868,461

[22] Filed: Jun. 3, 1997

[51] Int. Cl.[6] ..... E04H 4/00

[52] U.S. Cl. ..... 4/500

[58] Field of Search ..... 4/498, 500, 502, 4/541.1

[56] References Cited

U.S. PATENT DOCUMENTS

| | | | |
|---|---|---|---|
| 2,958,083 | 9/1960 | Shook et al. | 4/172 |
| 3,050,743 | 8/1962 | Lamb | 4/172 |
| 3,144,665 | 8/1964 | Meyer | 4/172 |
| 3,501,783 | 3/1970 | Broadman | 4/172 |
| 3,864,761 | 2/1975 | Stalder | 4/502 |
| 4,059,855 | 11/1977 | Riendeau | 4/172 |
| 4,203,174 | 5/1980 | Shults | 4/172 |
| 4,234,973 | 11/1980 | Vetter et al. | 4/500 |
| 4,717,196 | 1/1988 | Adams | 296/98 |
| 5,040,843 | 8/1991 | Russell et al. | 296/98 |
| 5,367,722 | 11/1994 | Pesterfield | 4/499 |

FOREIGN PATENT DOCUMENTS

| | | | |
|---|---|---|---|
| 2450927 | 11/1980 | France | 4/502 |

*Primary Examiner*—Charles E. Phillips

*Attorney, Agent, or Firm*—Chernoff, Vilhauer, McClung & Stenzel, LLP

[57] ABSTRACT

A hot tub has a bathing enclosure surrounded by a peripheral tub wall. The tub wall has a peripheral upper rim at a level above a surrounding tub-supporting surface. The tub has a water recalculating system for maintaining water in the tub at a level below that of the rim. The tub has a covering apparatus which includes a vertically extending support structure exterior to the tub wall. A drive is mounted on the support structure exterior to the tub wall. A pair of laterally opposed elongate tracks is mounted on the support structure exterior to the tub wall and extends vertically below the level of the upper rim, with each track having an upper end terminating adjacent to the upper rim. A cover is comprised of a plurality of elongate, substantially rigid segments each having a longitudinal axis. Each segment is pivotally interconnected in a direction transverse to the longitudinal axis and movably engageable with the drive and with the opposing tracks. The segments span, and are movably supported, atop opposing portions of the upper rim so as not to contact the water. The segments are pushable by the drive along the opposing portions of the peripheral upper rim, while supported thereby in a direction transverse to the longitudinal axis of the elongate segments.

8 Claims, 3 Drawing Sheets

HOT TUB WITH COVERING APPARATUS

BACKGROUND OF THE INVENTION

This invention relates to a hot tub having a retractable roll-top cover.

A typical hot tub used for bathing will generally accommodate several people and may contain up to 500 gallons of water. Hot tubs are generally operated with water temperatures ranging from 85° to 105° F. Hot tubs are particularly popular in colder climates. Because hot tubs are often used outdoors, these hot tubs may be subject to operation in subfreezing temperatures.

Hot tubs present several problems for their owners and operators. Because the tubs contain many gallons of water and are heated, often in colder climates, it is very important to provide an insulated cover for the hot tub. The insulation should retain the heat of the hot tub in order to decrease the costs associated with heating the water as well as to decrease the amount of time necessary to heat the water to a desired temperature.

In addition, it is desirable that the hot tub be covered when not in use for safety reasons. A-hot tub generally contains many gallons of water and poses safety concerns for small children. Children who fall into a hot tub face a serious risk of drowning. It is therefore desirable that a cover for the hot tub be capable of easy installation, and also that it be lockable so that it may not be removed except when in operation by an adult. The cover should also be sturdy to prevent children from lifting or prying under the cover.

In addition, the cover should be strong enough to support heavy loads placed upon the cover. Because the hot tub may be placed in an outdoor cold environment, snow and ice may accumulate on top of the cover. The cover, therefore, should be capable of supporting such accumulations of snow and ice. In addition, the cover should be capable of supporting the weight of an adult or child who steps upon the cover so that the person does not inadvertently fall into the hot tub through the cover.

The warm, moist environment contained in the hot tub creates another problem for covers. Covers may trap moisture and cause condensation buildup within the tub and on the cover. This can cause the cover to become heavy and waterlogged. The warm, moist environment within the hot tub is also conducive to growth of algae and mold. The cover should therefore be breathable so as to reduce condensation and to prevent the growth of algae and mold while the cover is placed on top of the hot tub.

It is also important that the cover not interfere with the use of the hot tub itself. The wet slippery surfaces in and around the hot tub pose a risk of slipping or falling when entering or exiting the hot tub. The rim of the hot tub should be free from obstacles, such as tracks or other apparatus for a cover, which may interfere with the ease of entry into and exit from the hot tub. Hot tubs are also typically sold with a high-gloss acrylic surface, and it is important that the hot tub cover not scratch, mar or interfere with the high-gloss surface.

Finally, a hot tub cover should be capable of easy installation and removal. Because it is important for safety reasons to keep the hot tub covered when not in use, the hot tub cover should be easily placed on top of the hot tub. In addition, because the hot tub is often used in cold environments, it is desirable to have quick and easy removal and installation of the hot tub cover when bathers are outside in cold climates. The cover should also be capable of easy removal even after snow and ice have accumulated on top of the cover.

One prior art hot tub cover provides a two-piece hard shell fiberglass cover. When folded open, these types of covers rest flat on top of the peripheral upper rim of a hot tub. These types of covers, however, are not capable of supporting heavy loads, are difficult to remove when covered with snow or ice, and are difficult to store when not in use. These covers are also susceptible to becoming waterlogged due to the buildup of condensation within the cover. They are also quite bulky and difficult to install and remove.

What is desired, therefore, is a hot tub having a covering apparatus that is insulated, is rigid when covering the hot tub, is capable of supporting heavy loads, is easily removable from the hot tub even after periods of snow and ice, is lockable, is breathable so as to reduce condensation and to prevent growth of mold and algae, does not interfere with access or exit from the hot tub, is easily stored when not in use, and does not detract from the aesthetics of the hot tub.

SUMMARY OF THE INVENTION

The present invention overcomes the aforementioned drawbacks of the prior art by providing a hot tub with a bathing enclosure surrounded by a peripheral tub wall that has a peripheral upper rim at a level above a surrounding tub-supporting surface. The tub also has a water recirculating system for maintaining water in the tub at a level below that of the rim. The tub has a covering apparatus which includes a vertically extending support structure exterior to the tub wall. A drive is mounted on the support structure exterior to the tub wall. A pair of laterally opposed elongate tracks is mounted on the support structure exterior to the tub wall and extends vertically below the level of the upper rim, with each track having an upper end terminating adjacent to the upper rim. A cover is comprised of a plurality of elongate, substantially rigid segments, each having a longitudinal axis. The segments are pivotally interconnected in a direction transverse to the longitudinal axis of the segments and movably engageable with the drive and with the opposing tracks. The segments span, and are movably supported, atop opposing portions of the upper rim so as not to contact the water. The segments are pushable by the drive along the opposing portions of the peripheral upper rim, while supported thereby in a direction transverse to the longitudinal axis of the elongate segments.

The aforementioned hot tub provides a strong, insulated cover that is easily removable even after snow and ice have accumulated on the cover, and the segments provide a breathable environment for the hot tub. Also, the segmented cover retracts completely to provide unobstructed access (on three sides) into and out of the hot tub. Moreover, the cover does not interfere with the aesthetics of the hot tub and is easily stored when not in use.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
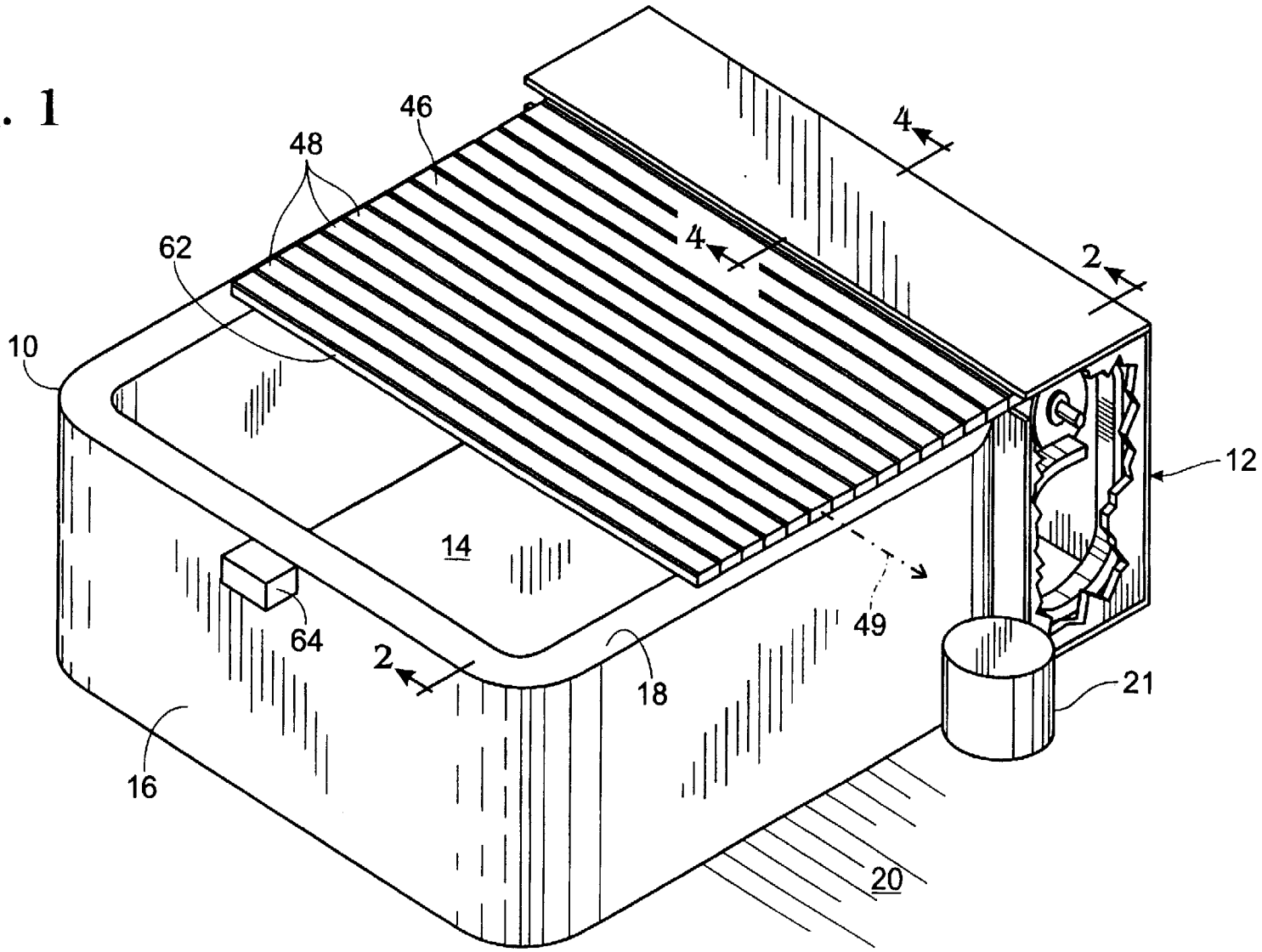
FIG. 1 is a perspective view of a hot tub with a covering apparatus partially broken away.

Referring now to the figures, where like numerals refer to like elements, FIG. 1 shows a perspective view of a hot tub 10 with covering apparatus 12. Hot tub 10 has a bathing enclosure 14 surrounded by a peripheral tub wall 16 having a peripheral upper rim 18 at a level above a surrounding tub-supporting surface 20. Hot tub 10 has a water recirculating system 21 for maintaining water in hot tub 10 at a level below that of upper rim 18. Hot tub 10 also has a heating mechanism for maintaining the temperature of the water in the hot tub. Typical hot tubs are capable of maintaining 500 gallons of water at temperatures in the general range of 85° to 105° F. Typically, tub wall 16 and upper rim 18 are made-from high-gloss acrylic materials.

Figure 3:
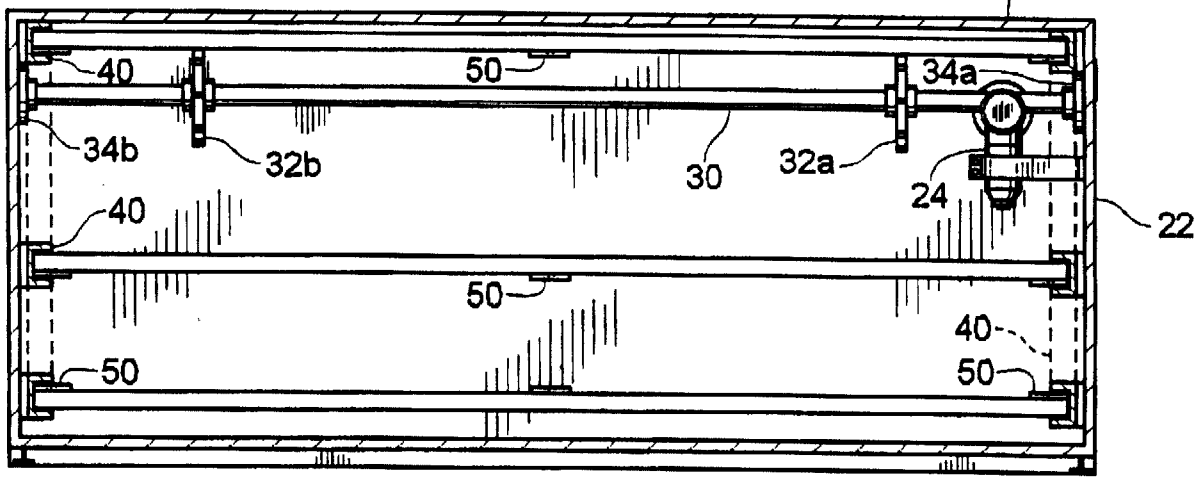
FIG. 3 is a sectional view of the covering apparatus taken along line 3—3 of FIG. 2.

Referring to FIG. 3 the covering apparatus 12 has a vertically extending support structure 22 exterior to tub wall 16. A motor 24 is mounted to support structure 22. Motor 24 is connected to shaft 30. A disengagement mechanism (not shown) is connected to motor 24 to disengage motor 24 from shaft 30. A hand crank (not shown) may be operatively interconnected with drive shaft 30 to allow manual operation when motor 24 is disengaged. Support structure 22 has a top enclosure and side panels to provide an enclosed storage area.

Figure 4:
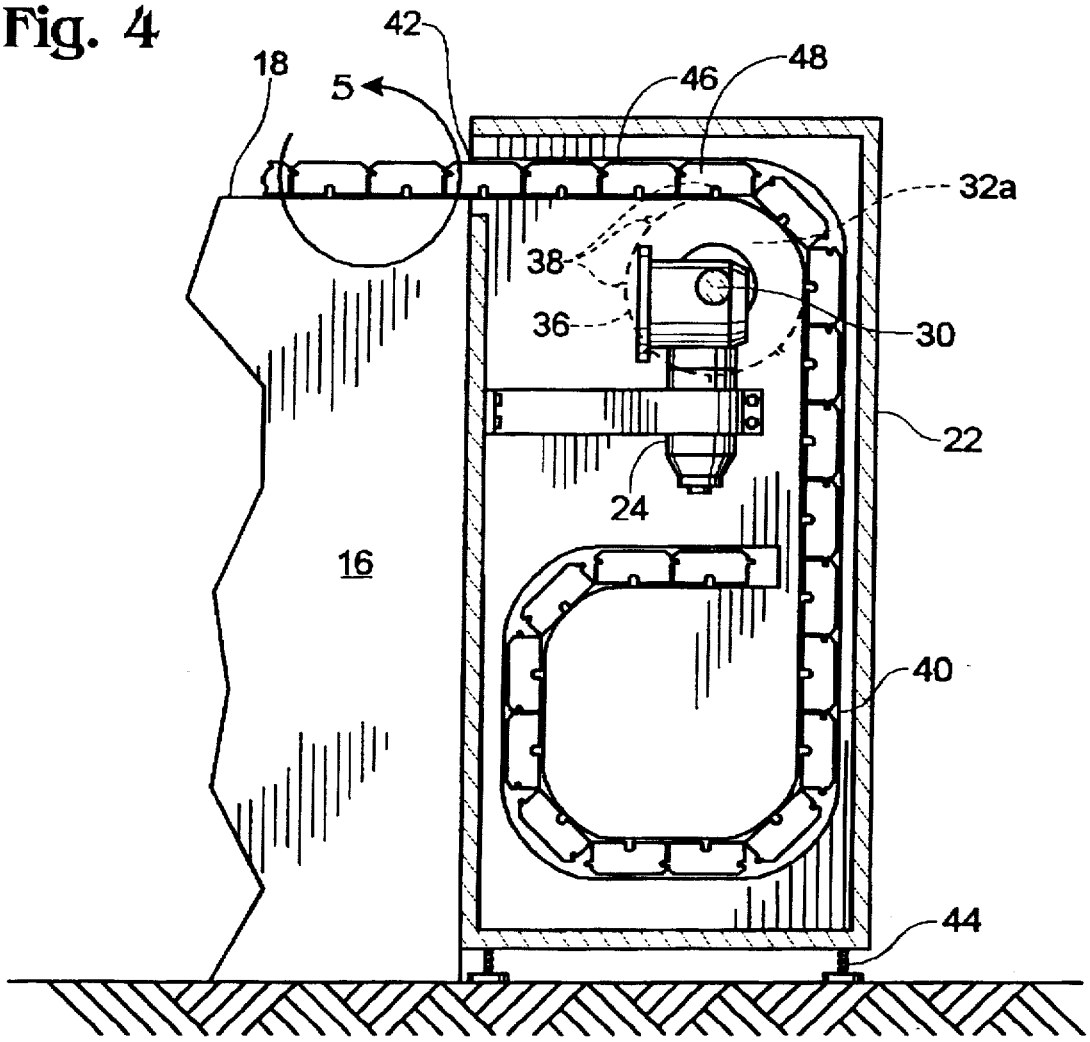
FIG. 4 is a sectional view of the covering apparatus taken along line 4—4 of FIG. 1.

Motor 24 is a low rpm gear motor capable of providing low rpm and high torque. Preferably, motor 24 is capable of producing 2 to 3 rpms and 250 ft lbs of torque. Motor 24 may be a variable-speed motor. Drive shaft 30 has two gear rollers **32*a* and 32*b*. Drive shaft 30 is supported by support structure 22 by roller bearing mounts 34*a* and 34*b*. Referring to FIG. 4, gear roller 32*a* has an outer periphery 36 and teeth 38. Gear roller 32*a* preferably has a diameter of 8" and the teeth 38 protrude approximately ⅛" beyond the outer periphery 36. Gear roller 32*a*** is preferably made of aluminum or plastic.

A pair of laterally opposed elongate tracks 40 are mounted to opposite sides of support structure 22. Tracks 40 are made of aluminum and curve along the interior of the support structure 22. Tracks 40 are mounted on support structure 22 exterior to tub wall 16 and extend vertically below the level of upper rim 18. Each track 40 has an upper end 42 terminating adjacent to upper rim 18. Support structure 22 has a vertical adjustment mechanism 44 so that upper end 42 may be positioned at the level of upper rim 18.

Figure 2:
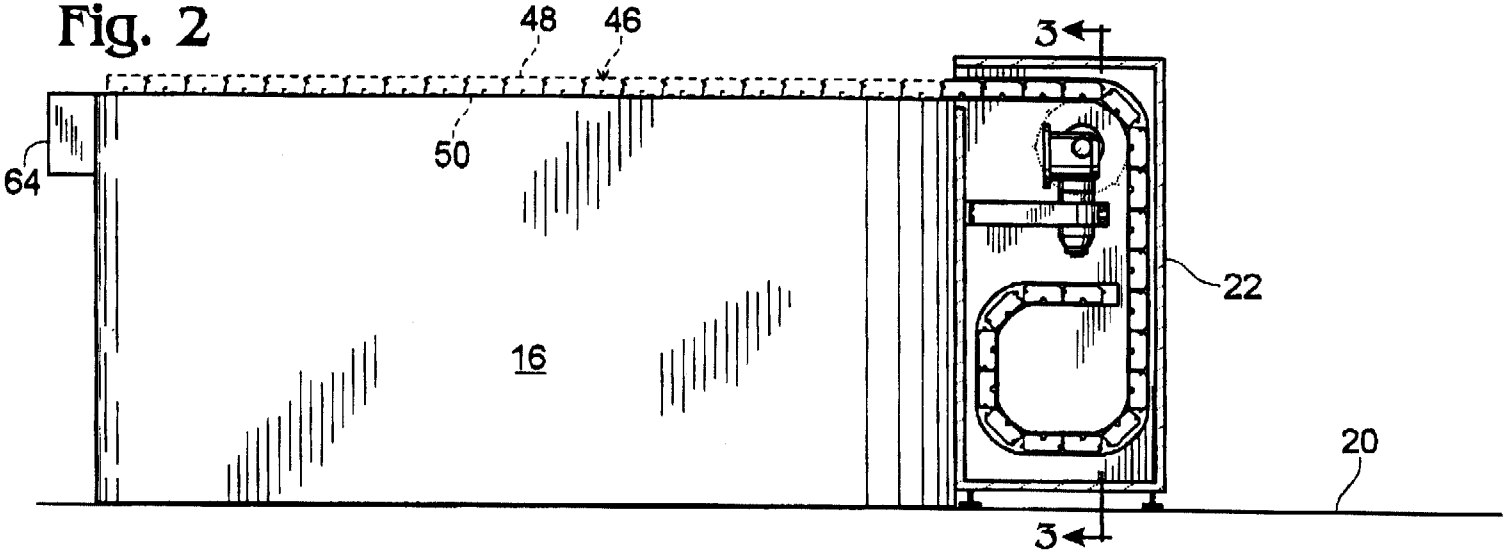
FIG. 2 is a sectional view of the hot tub with covering apparatus taken along line 2—2 of FIG. 1.

Referring to FIGS. 1 and 2, a cover 46 is comprised of a plurality of elongate, substantially rigid interlocking segments 48, each segment having a longitudinal axis 49. Each segment 48 is preferably about 3½ inches wide and 1½ inches thick. Segments 48 are pivotally interconnected by a strip 50 in a direction transverse to longitudinal axis 49. Strip 50 is preferably a rubber-type belt approximately 1½" to 3" wide connected to the underside of segments 48 by a mechanical fastening device, such as a screw. The strip 50 may also be connected to segments 48 by adhesive. Strip 50 is flexible and allows segments 48 to move pivotally with respect to one another when moving along tracks 40. Strip 50 preferably has a coating of polyvinylchloride (PVC) plastic or similar material. Strip 50 is connected to segments 48 so that when cover 46 is on top of hot tub 10, strip 50 is in contact with upper rim 18. Preferably, cover 46 has three strips 50, one along each side of cover 46 and one along the center of cover 46, each strip 50 interconnecting each of segments 48 of cover 46 in a direction transverse to longitudinal axis 49.

Figure 5:
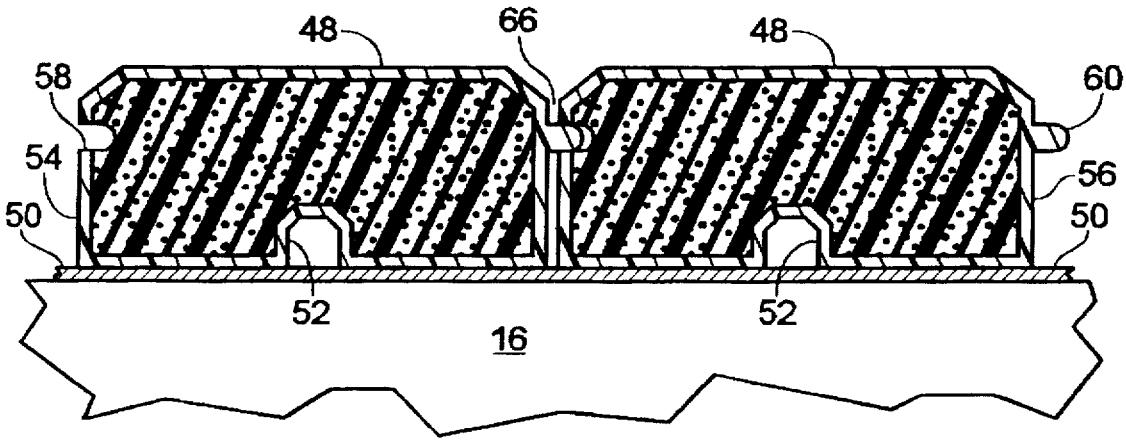
FIG. 5 is a detailed sectional view showing two segments of the covering apparatus atop the hot tub of FIG. 1.

Referring to FIG. 5, strip 50 provides for a smooth surface along which cover 46 contacts peripheral upper rim 18. Preferably, strip 50 is coated with PVC or some other similar material to provide a smooth surface. This prevents marring or scratching of the high-gloss acrylic surface typically used for hot tubs. Strip 50 also creates a seal between cover 46 and peripheral upper rim 18 to aid in the insulation of the water within hot tub 10.

Segments 48 are made from a rigid plastic material such as PVC with UV protection, such that each segment 48 is substantially rigid so that cover 46 is capable of supporting the weight of a child or adult. The interior of segments 48 may be of a honeycomb-type construction or may be filled with insulating foam. Segments 48 provide insulation for hot tub 10, and preferably provide an insulating R value of 13 to 25 which may be achieved through use of foam or honeycomb cells. Segments 48 are engageable with gear rollers **32*a* and 32*b*. Referring to FIG. 5, each segment 48 defines a notch 52 which corresponds with teeth 38 of gear rollers 32*a* and 32*b*. In operation, teeth 38 fit into notches 52 (as shown in FIG. 4) thereby allowing gear roller 32 to engage segments 48 and move cover 46 in a direction transverse to longitudinal axis 49 of segments 48**.

Segments 48 are likewise engageable with opposing tracks 40. When cover 46 is fully retracted inside of support structure 22, segments 48 span and are supported by opposing tracks 40. Opposing tracks 40 are of sufficient length and oriented within support structure 22 so as to fully accommodate cover 46 within support structure 22 when cover 46 is fully retracted from hot tub 10. Because support structure 22 provides an enclosed storage area, cover 46 is kept dry when not in use and prevents growth of mold or algae on cover 46 when in storage. Cover 46 is also out of sight when not in use inside support structure 22, and does not detract from the aesthetics of hot tub 10.

When cover 46 is pushed atop hot tub 10, segments 48 span and are movably supported atop opposing portions of peripheral upper rim 18. Because cover 46 rests atop upper rim 18 it does not contact the water within hot tub 10 which is at a level below that of the upper rim 18. Cover 46 therefore remains relatively dry and less susceptible to growth of mold or algae. Because cover 46 moves across a smooth upper rim 18, less energy is required to move cover 46 than if it were moved across the surface of the water.

Segments 48 are pushable by gear rollers **32*a* and 32*b* along opposing portions of peripheral upper rim 18, while supported by upper rim 18 in a direction transverse to longitudinal axis 49 of elongate segments 48. In operation, when motor 24 is engaged with shaft 30, motor 24 causes gear rollers 32*a*, 32*b* to engage segments 48. Thus, cover 46 may be pushed across the peripheral upper rim 18 in a transverse direction to longitudinal axis 49. Motor 24 is reversible so that cover 46 may also be fully retracted within support structure 22**.

Referring to FIG. 5, each segment 48 has a front side 54 and a back side 56. Front side 54 defines a U-shaped groove 58 within segment 48. Groove 58 is approximately 0.260 inch deep and has an outer opening width of 0.236 inch. The back side 56 has a tongue 60, which is approximately 0.197 inch wide and which extends approximately 0.25 inch from back side 56. When segments 48 are aligned adjacent each other atop upper rim 18, tongue 60 of one segment 48 fits inside groove 58 of an adjacent segment 48. Interlocking tongue 60 and groove 58 provide additional benefits to cover 46. Together they provide additional rigidity to cover 46 and therefore allow cover 46 to support heavier loads. Tongue 60 and groove 58 also maintain the alignment of segments 48 while cover 46 is being pushed over peripheral upper rim 18. Interlocking tongue 60 and groove 58 also provide additional rigidity to cover 46 as a whole. This prevents individual segments 48 from being pried or lifted away from upper rim 18 to allow access to hot tub 10 when cover 46 is on top of hot tub 10. A front end 62 of cover 46 may be locked with a locking mechanism 64 to prevent access to hot tub 10 when cover 46 is fully extended (see FIG. 1).

Having cover 46 made from individual segments 48 provides several benefits. First, the separation between individual segments 48 creates spaces 66 which allow a path for moisture to escape from underneath cover 46 when it is on top of hot tub 10. Because cover 46 is breathable it prevents condensation buildup and inhibits growth of mold and algae underneath cover 46 when hot tub 10 is not in use and cover 46 is atop hot tub 10. In addition, spaces 66 between segments 48 allow a small amount of warm air to escape from underneath cover 46. This aids retraction of cover 46 after it has been covered with snow or ice. The warm air escaping from spaces 66 between segments 48 melts the snow and ice on top of cover 46 between segments 48 and allows cover 46 to be easily retracted even after snow and ice have accumulated on top of cover 46.

The present invention also provides for unobstructed access into and out of hot tub 10. Cover apparatus 12 does not require any external guides, rails, wires or ropes above peripheral tub wall 16 which could interfere with access to hot tub 10. Cover apparatus 12 thus does not create any additional hazards for slipping or falling in or around hot tub 10. In addition, because cover 46 retracts completely within support structure 22, cover 46 does not detract from the aesthetics of hot tub 10.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A hot tub having a bathing enclosure surrounded by a peripheral tub wall having a peripheral upper rim at a level above a surrounding tub-supporting surface and a water recirculating system for maintaining water in said tub at a level below that of said upper rim, said tub having a covering apparatus comprising:

(a) a vertically-extending support structure exterior to said tub wall;

(b) a drive mounted on said support structure exterior to said tub wall;

(c) a pair of laterally-opposed elongate tracks mounted on said support structure exterior to said tub wall and extending vertically below said level of said upper rim, each said track having an upper end terminating adjacent to said upper rim; and (d) a cover comprising a plurality of elongate, substantially rigid segments, each segment having a longitudinal axis, said segments pivotally interconnected in a direction transverse to said longitudinal axis and movably engageable with said drive and with said opposing tracks, said segments spanning and being movably supported atop opposing portions of said peripheral upper rim so as not to contact said water, and being pushable by said drive along said opposing portions of said peripheral upper rim, while supported thereby, in a direction transverse to said longitudinal axis of said elongate segments.

2. The hot tub of claim 1 wherein said support structure is an enclosure.

3. The hot tub of claim 1 wherein said drive has a roller, said roller has protrusions along an outer periphery and each of said segments has a recess, said protrusions matingly engageable with each said recess.

4. The hot tub of claim 1 wherein each of said segments has a tongue on one longitudinal side and a groove on an opposite longitudinal side.

5. The hot tub of claim 1 wherein an elastic strip extending transversely to said longitudinal axis pivotally interconnects each of said segments to an adjacent segment.

6. The hot tub of claim 5 wherein said elastic strip is between said segments and said peripheral upper rim when said segments are supported atop said peripheral upper rim.

7. The hot tub of claim 1 wherein each of said segments contains thermal insulation.

8. The hot tub of claim 1, including a locking mechanism operatively connectable to said cover for selectively preventing movement of said cover.

* * * * *

UNITED STATES PATENT AND TRADEMARK OFFICE

CERTIFICATE OF CORRECTION

PATENT NO. : 5,761,750

DATED : June 9, 1998

INVENTOR(S) : Charles Thomas Mazzola et al.

It is certified that error appears in the above-identified patent and that said Letters Patent is hereby corrected as shown below:

On the title page, item [57] in the Abstract line 4:

Change "recalculating" to read --recirculating--.

Signed and Sealed this

Twenty-seventh Day of July, 1999

*Attest:*

Q. TODD DICKINSON

*Attesting Officer*

*Acting Commissioner of Patents and Trademarks*